US006386925B1

(12) United States Patent
Sato et al.

(10) Patent No.: US 6,386,925 B1
(45) Date of Patent: May 14, 2002

(54) PRESS-CONTACT JOINT CONNECTOR

(75) Inventors: Kei Sato; Akira Maeda, both of Shizuoka-ken (JP)

(73) Assignee: Yazaki Corporation (JP)

( * ) Notice: Subject to any disclaimer, the term of this patent is extended or adjusted under 35 U.S.C. 154(b) by 0 days.

(21) Appl. No.: 09/543,751

(22) Filed: Apr. 5, 2000

(30) Foreign Application Priority Data

Apr. 6, 1999 (JP) ..... 11-099332

(51) Int. Cl.[7] ..... H01R 11/20
(52) U.S. Cl. ..... 439/701; 439/907
(58) Field of Search ..... 439/626, 634, 439/646, 658, 660, 686, 701, 708, 709, 710, 723, 741, 796, 885, 189, 907

(56) References Cited

U.S. PATENT DOCUMENTS 3,651,449 A * 3/1972 Hall et al. ..... 339/244 R
4,322,120 A * 3/1982 Rilling ..... 339/47 R
4,753,614 A * 6/1988 Weiner ..... 439/717
5,288,250 A * 2/1994 Sumida ..... 439/701
5,288,251 A * 2/1994 Simida ..... 439/701
5,716,241 A * 2/1998 Hennemann ..... 439/716
5,947,774 A * 9/1999 Abe ..... 439/701
6,007,386 A * 12/1999 Okabe ..... 439/701

* cited by examiner

*Primary Examiner*—Tulsidas Patel
*Assistant Examiner*—Charles J Peschel
(74) *Attorney, Agent, or Firm*—Finnegan, Henderson, Farabow, Garrett & Dunner, L.L.P.

(57) ABSTRACT

A press-contact joint connector includes: a first connector housing having a plurality of cavity walls formed with a plurality of terminal housing chambers; and a terminal assembly having a plurality of terminals to be housed respectively in said plurality of terminal housing chambers, and having a plurality of carrier portions for connecting said plurality of terminals. In the above construction, notched portions are formed respectively in positions of said cavity walls corresponding to said carrier portions. Carrier cutting holes are formed below said notched portions. The carrier portions are composed of lower surface portions, stand portions and upper surface portions for connecting said adjacent stand portions. Overlap portions which are arranged so as to overlap said cavity walls are formed in positions correspondingly to said stand portions of said carrier portions.

7 Claims, 17 Drawing Sheets

PRESS-CONTACT JOINT CONNECTOR

BACKGROUND OF THE INVENTION

1. Field of the Invention

The present invention relates to a press-contact joint connector which is constituted so that connector housings are connected in a multiple stage form.

2. Description of the Related Art

A connector housing of a press-contact joint connector is provided with a plurality of terminal housing chambers which are partitioned by cavity walls, and terminal engagement portions are provided respectively to the terminal housing chambers. A plurality of terminals to be respectively mounted into the plurality of terminal housing chambers are engaged with the terminal engagement portions, and are housed respectively in the terminal housing chambers. The plurality of terminals are composed as a terminal assembly in a stage before they are attached to the connector housing, and the terminal assembly is composed of the plurality of terminals arranged in parallel and carrier portions which connect the terminals.

However, in the above conventional press-contact joint connector, since carrier portions of the terminal assembly are formed into the continuous wave form as mentioned above, the carrier portions are arranged on the cavity walls as follows. Namely, uncut sections of the carrier portions are arranged so as to stretch over the cavity walls 4, the sections where cut spaces are formed are arranged so that the cut end surfaces of the carrier portions face each other across the notched portions. Therefore, when vibration or external force is applied to the carrier portions, the cut end surfaces of the carrier portions are brought into contact with each other, and thus the adjacent terminals are possibly short-circuited.

In addition, when the electric wires are bent, the cavity walls and the carrier portions are bent by the external force. As a result, the cut end surfaces of the carrier portions come in contact with each other, and the adjacent terminals are short-circuited.

SUMMARY OF THE INVENTION

The present invention is devised with such points in view. It therefore is an object of the present invention to provide a press-contact joint connector which is capable of ensuring insulation between adjacent terminals.

A first aspect of the invention provides a press-contact joint connector which includes: a first connector housing having a plurality of cavity walls, said first connector housing being formed with a plurality of terminal housing chambers by partitioning said first connector housing by said plurality of cavity walls; a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein notched portions are formed respectively in positions of said cavity walls corresponding to said carrier portions; carrier cutting holes are formed below said notched portions of said first connector housing; said carrier portions are composed of lower surface portions provided along bottom surfaces of said terminal housing chambers, stand portions which stand from said lower surface portions, and upper surface portions for connecting said adjacent stand portions; and overlap portions which are arranged so as to overlap said cavity walls are formed in positions correspondingly to said stand portions of said carrier portions.

In the press-contact joint connector according to the first aspect, sections of cut spaces are arranged so that cut end surfaces of carrier portions face each other across the notched portions, and even if an external force is applied in a direction where the adjacent stand portions come close to each other, the overlap portions of the stand portions abut against the cavity walls so that displacement is prevented. As a result, the cut end surfaces of the carrier portions do not contact with each other. Therefore, insulation between the adjacent terminals can be ensured.

A second aspect of the invention provides a press-contact joint connector which includes: a first connector housing having a plurality of cavity walls, said first connector housing being formed with a plurality of terminal housing chambers by partitioning said first connector housing by said plurality of cavity walls; a second connector housing being connected to an upper surface of said; first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein notched portions are formed respectively in positions of said cavity walls corresponding to said carrier portions; carrier cutting holes are formed below said notched portions of said first connector housing; said carrier portions are composed of lower surface portions provided along bottom surfaces of said terminal housing chambers, stand portions which stand from said lower surface portions, and upper surface portions for connecting said adjacent stand portions; and wherein cavity holding portions which sandwich said cavity walls to rear of said notched portions are provided to a lower surface of said second connector housing.

In the press-contact joint connector according to the second aspect, the sections of the cut spaces are arranged so that the cut end surfaces of the carrier portions face each other across the notched portions, and even if an external force is applied to the cavity walls due to bending of electric wires, displacement of the cavity walls can be prevented by the cavity holding portion. As a result, the cut end surfaces of the carrier portions do not contact.

A third aspect of the invention provides the press-contact joint connector which includes: a first connector housing having a plurality of cavity walls, said first connector housing being formed with a plurality of terminal housing chambers by partitioning said first connector housing by said plurality of cavity walls; a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein said carrier portions are composed of lower surface portions provided along bottom surfaces of said terminal housing chambers, stand portions which stand from said lower surface portions, and upper surface portions for connecting said adjacent stand portions; said upper surface portion is cut; and said two stand portions which are separated by cutting said upper surface portion are bent respectively into said terminal housing chambers.

In the press-contact joint connector according to the third aspect, since the interval between the cut end surfaces of the carrier portions becomes larger, even if an external force is applied in a direction where the adjacent stand portions come close to each other, the cut end surfaces of the carrier portions do not contact.

A fourth aspect of the invention provides the press-contact joint connector which includes: a first connector housing having a plurality of cavity walls, said first connector housing being formed with a plurality of terminal housing chambers by partitioning said first connector housing by said plurality of cavity walls; a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein said carrier portions are composed of lower surface portions provided along bottom surfaces of said terminal housing chambers, stand portions which stand from said lower surface portions, and upper surface portions for connecting said adjacent stand portions; and said upper surface and said stand portions on both the sides connected to said upper surface are cut.

In the press-contact joint connector according to the fifth embodiment, since the interval between the cut end surfaces of the carrier portions becomes larger, even if an external force is applied in a direction where the adjacent stand portions come close to each other, the cut end surfaces of the carrier portions do not contact with each other.

According to a fifth aspect of the present invention, as it depends from the first, third or fourth aspect, wherein cavity holding portions which sandwich rear portions of said cavity walls are provided to a lower surface of said second connector housing.

According to the fifth aspect of the present invention, even if an external force is applied to the cavity walls due to bending of the electric wires, displacement of the cavity walls is prevented by the cavity holding portions. As a result, the cut end surface of the carrier portions do not contact with each other. Therefore, insulation between the adjacent terminals can be ensured, and the deformation of the cavity walls can be prevented.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
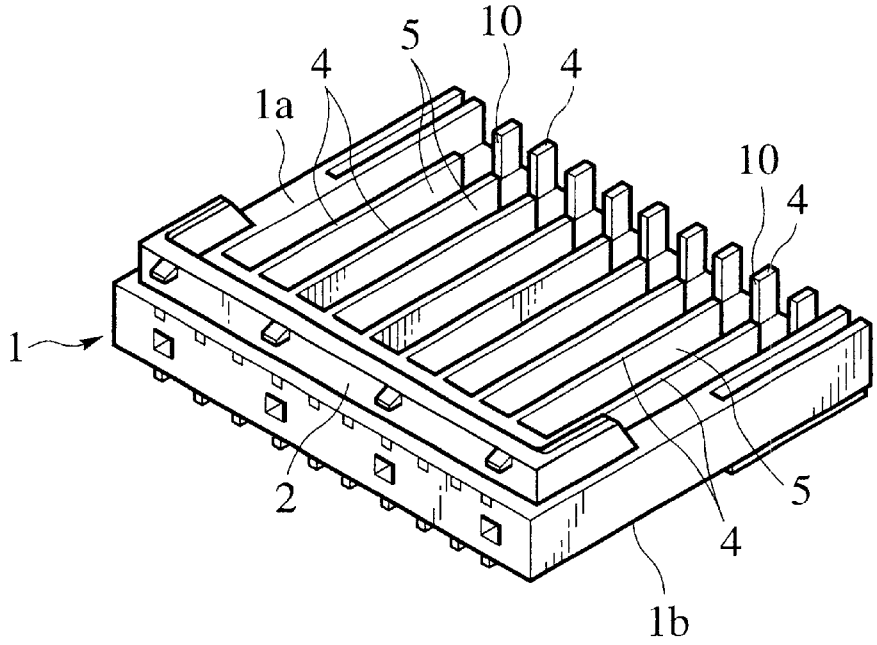
FIG. 1 is a perspective view of a connector housing of a press-contact joint connector according to a first embodiment of the present invention.
Figure 2:
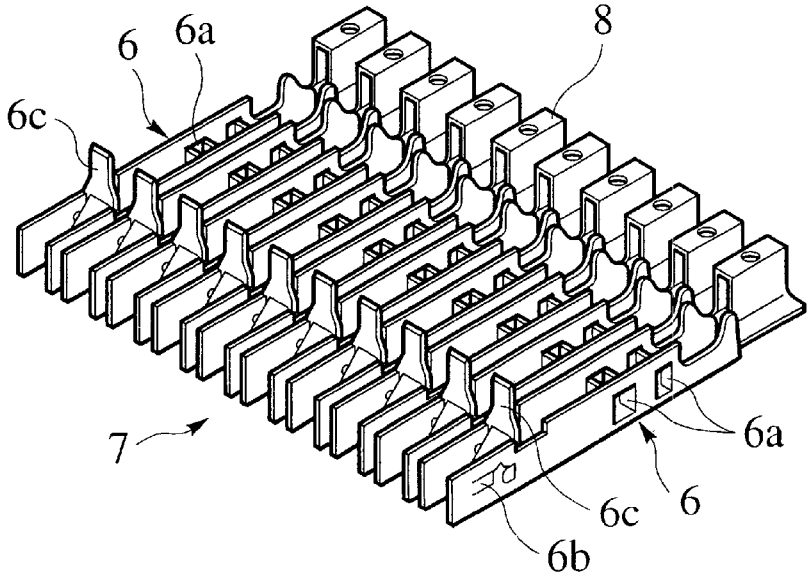
FIG. 2 is a perspective view of the terminal assembly.

There will be detailed below the preferred embodiments of the present invention with reference to the accompanying drawings. Like members are designated by like reference characters.

Referring now to FIG. 1 to FIG. 12B, a press-contact joint connector according to a first embodiment of the present invention will be described hereinbelow.

In FIGS. 1 through 7, as for the connector housing 1, its upper surface and lower surface are composed as connecting surfaces 1*a* and 1*b* respectively, and a housing lock protrusion 2 is provided to forward portions on both sides of the upper connecting surface 1*a* and to a substantially whole front surface portion, and a housing lock groove portion 3 (shown in FIG. 5) is provided to corresponding portions of the lower connecting surface 1*b*.

A plurality of terminal housing chambers 5 which are partitioned by cavity walls 4 are provided to the connector housing 1, and terminal engagement portions 1*c* are provided respectively to the terminal housing chambers 5. The plural terminals 6 are engaged with the terminal engagement portions 1*c* and are housed respectively in the terminal housing chambers 5. The plurality of terminals 6 are composed as a terminal assembly 7 shown in FIG. 2 in a stage before they are attached to the connector housing 1, and the terminal assembly 7 is composed of the plurality of terminals 6 arranged in parallel and carrier portions 8 which connect the terminals 6. The terminal assembly 7 is constituted in such a manner that plate-shaped electroconductive metal is blanked into a predetermined shape and it is bent and a plurality of terminals 6 are formed, and the carrier portion 8 which connects the plural terminals 6 are bent into a continuous wave shape. Namely, the carrier portions 8 are bent so that the terminal assembly 7 with a narrow pitch between the terminals 6 is formed.

The carrier portions 8 between the terminals 6 not requiring electrical connection are cut in the step of attaching the terminal assembly 7 to the connector housing 1, and cut spaces 9 are formed on the cut portions. There will be detailed below the cutting of the carrier portions 8.

The terminals 6 have electric wire press-contact portions 6*a* to which electric wires W are brought into press-contact respectively, housing engagement portions 6*b* which are engaged with the connector housing 1, tab portions 6*c* which are protruded to a side of the upper connecting surface 1*a*, and tab contact portions 6*d* (shown in FIG. 7) which contact with the tab portions 6*c* which are inserted from the lower connecting surface 1*b*. In addition, notched portions 10 are formed respectively on sections of the cavity walls 4 where the carrier portions 8 are positioned, and carrier cutting holes 11 are formed on sections of the connector housing 1 below the notched portions 10.

Figure 3:
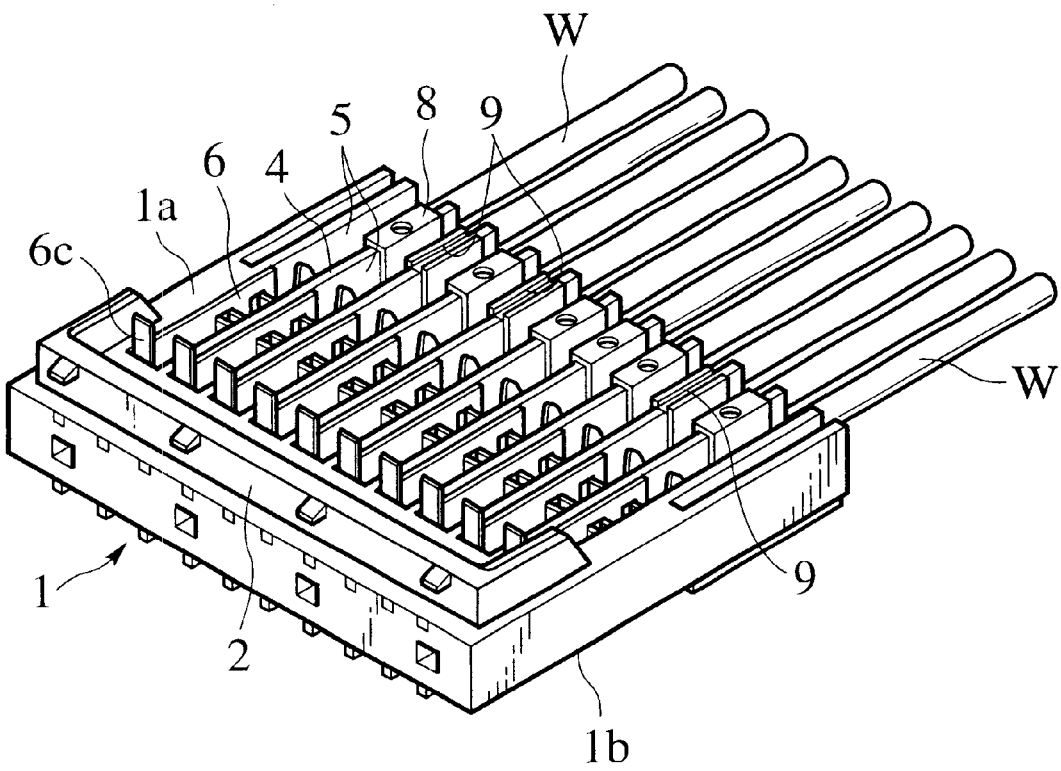
FIG. 3 is a perspective view of the connector housing in a state that the terminal assembly is attached.
Figure 4:
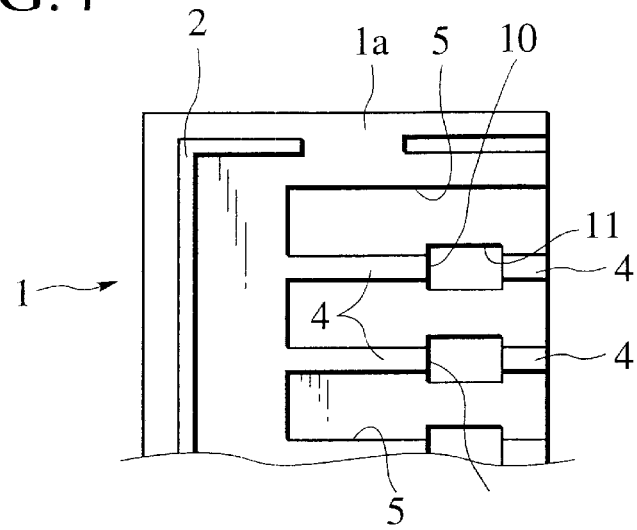
FIG. 4 is a plan view of the connector housing.
Figure 5:
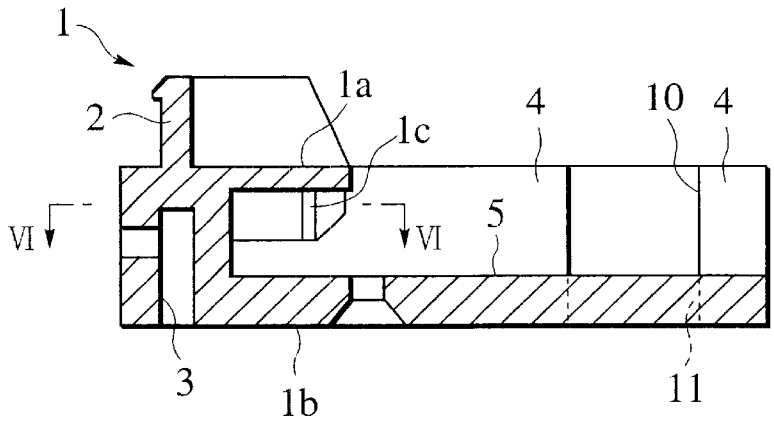
FIG. 5 is a cross section of the connector housing.
Figure 6:
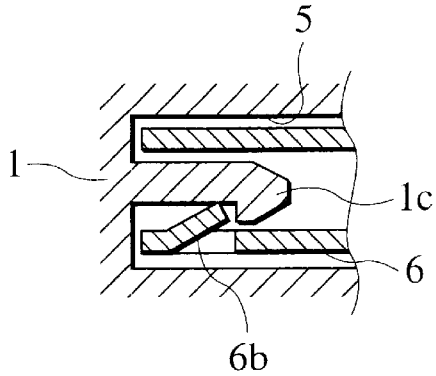
FIG. 6 is a cross section taken along the line VI—VI of FIG. 5 at the time of attaching the terminals.
Figure 7:
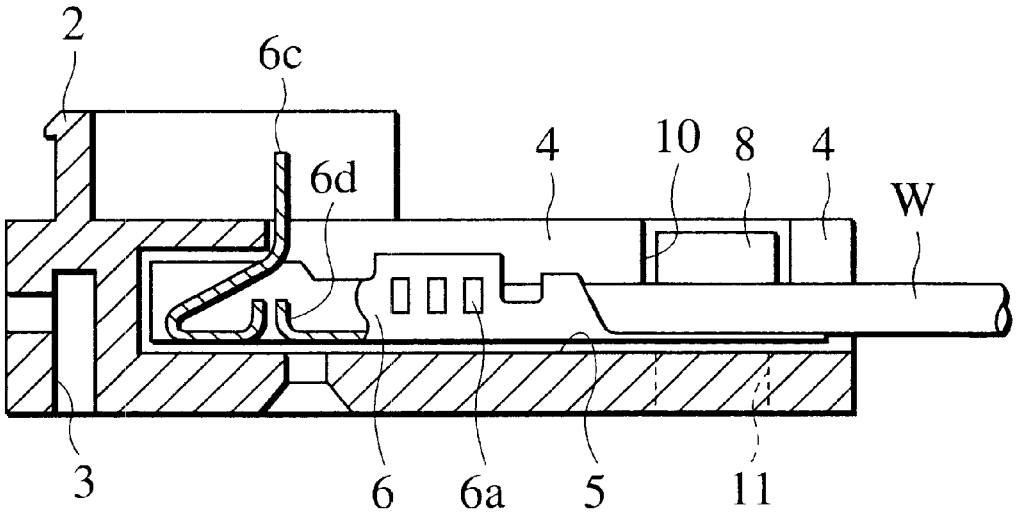
FIG. 7 is a cross section of the connector housing in a state that the terminal assembly is attached.

There will be described below the attachment of the terminals to the connector housing 1 and the connection of the connector housings 1. The terminal assembly 7 is inserted to a attachment position from rear surfaces of the terminal housing chambers 5 of the connector housing 1 as shown in FIG. 3. When the terminals 6 are inserted into the attachment position, the housing engagement portions 6*b* of the terminals 6 are engaged with the terminal engagement portions 1*c* of the connector housing 1. Next, the carrier portions 8 between the terminals 6 not requiring electrical connection are cut by using a carrier cut jig device 12.

Figure 8:
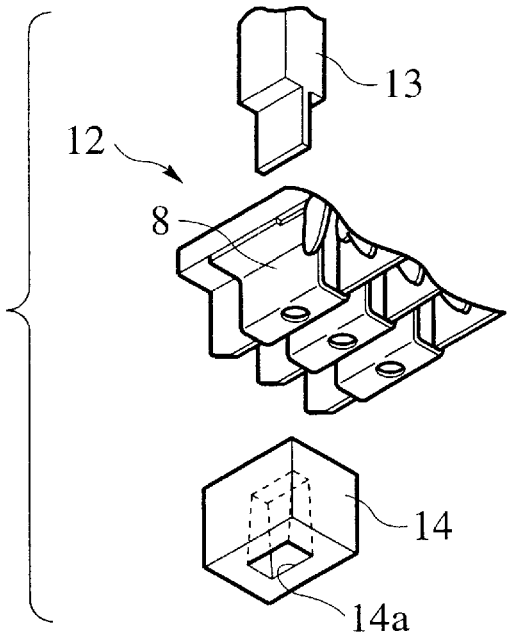
FIG. 8 is a perspective view showing a cutting work of carrier portions in the example.
Figure 9A:
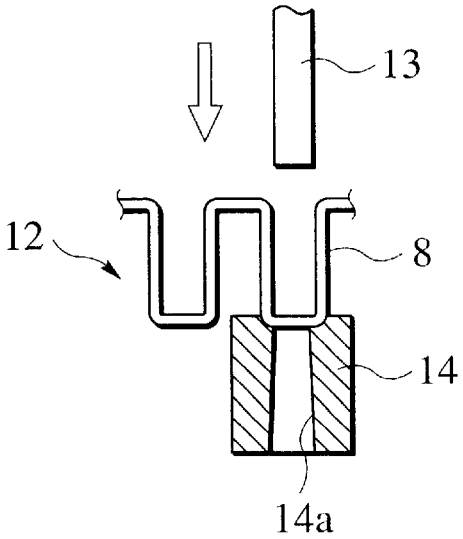
FIG. 9A is a cross section showing the cutting work of the carrier portion before the cutting in the example.
Figure 9B:
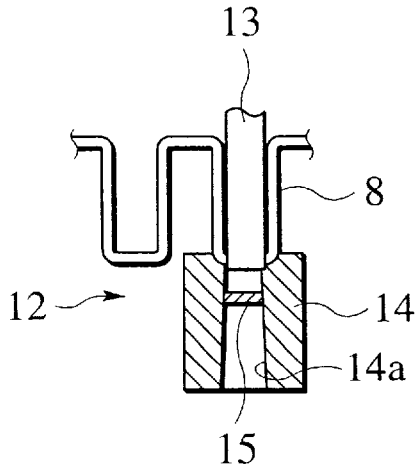
FIG. 9B is a cross section showing the cutting work of the carrier portion after the cutting.

As shown in FIG. 8, the carrier cut jig device 12 has a cutting blade 13 which is capable of moving up and down, and a carrier supporting stand 14 which is provided below the cutting blade 13 and has a hole 14*a*. As shown in FIG. 9A, a place of the carrier portion 8 to be cut is placed on the carrier supporting stand 14 by utilizing the notched portion 10 of the cavity wall 4, and cutting blade 13 is moved from up to down (direction of the arrow) by utilizing the carrier cutting hole 11, and the carrier portion 8 is pressed by the cutting blade 13. Then, the carrier portion 8 is cut at two surfaces and cut pieces 15 drop from the hole 14*a*, and a cut space 9 is formed at the carrier portion 8. In such a manner, all sections of the carrier portions 8 not requiring electric connection are cut.

Next, electric wires W are brought into press-contact with the electric wire press-contact portions 6*a* respectively so that the electric wires W are connected to the terminals 6.

Figure 23:
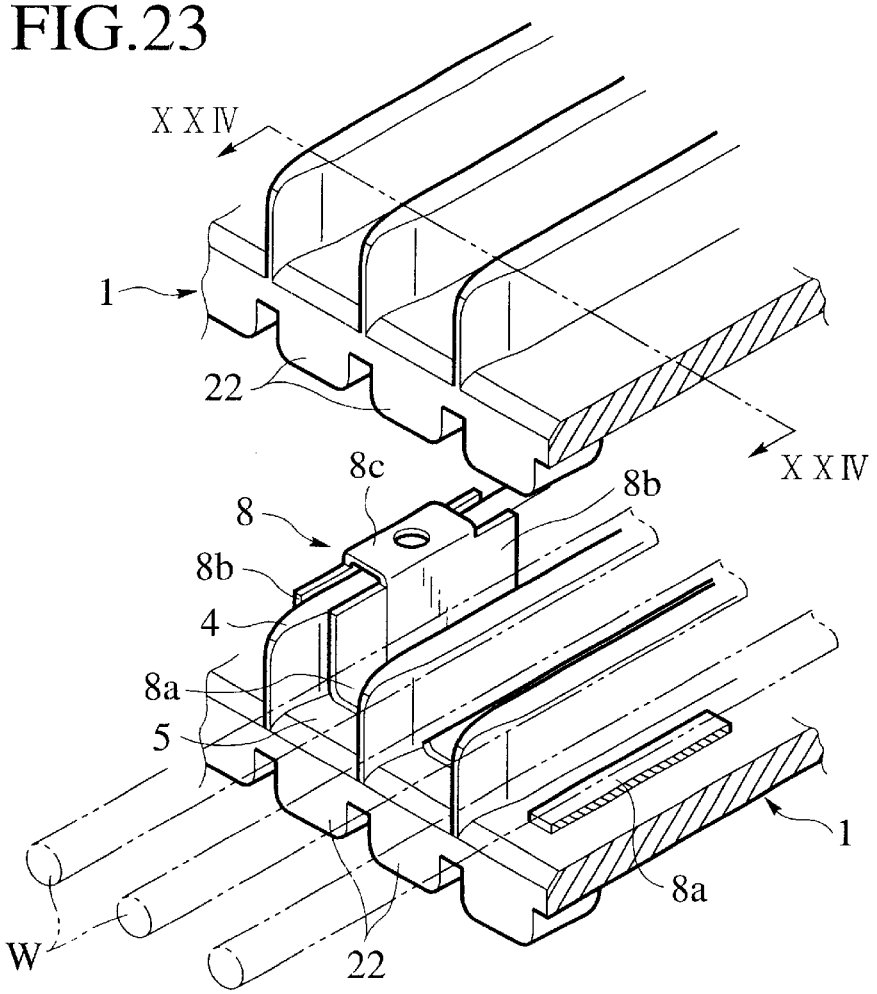
FIG. 23 is a partially exploded perspective view showing a rear side of the connected connector housing according to a sixth embodiment of the present invention.

Next, the connecting surfaces 1*a* and the connecting surfaces 1*b* of both the connector housings 1 are moved to a direction where they come close to each other, and the housing lock protrusions 2 and the housing lock groove portions 3 are located so as to meet each other. When they are located, the connecting surfaces 1*a* and the connecting surfaces 1*b* of both the connector housings 1 are further moved to the direction where they come close to each other, and when the connecting surfaces 1*a* and the connecting surfaces 1*b* are connected to each other, the housings are locked so that the connection is completed as shown in FIG. 23.

Figure 10:
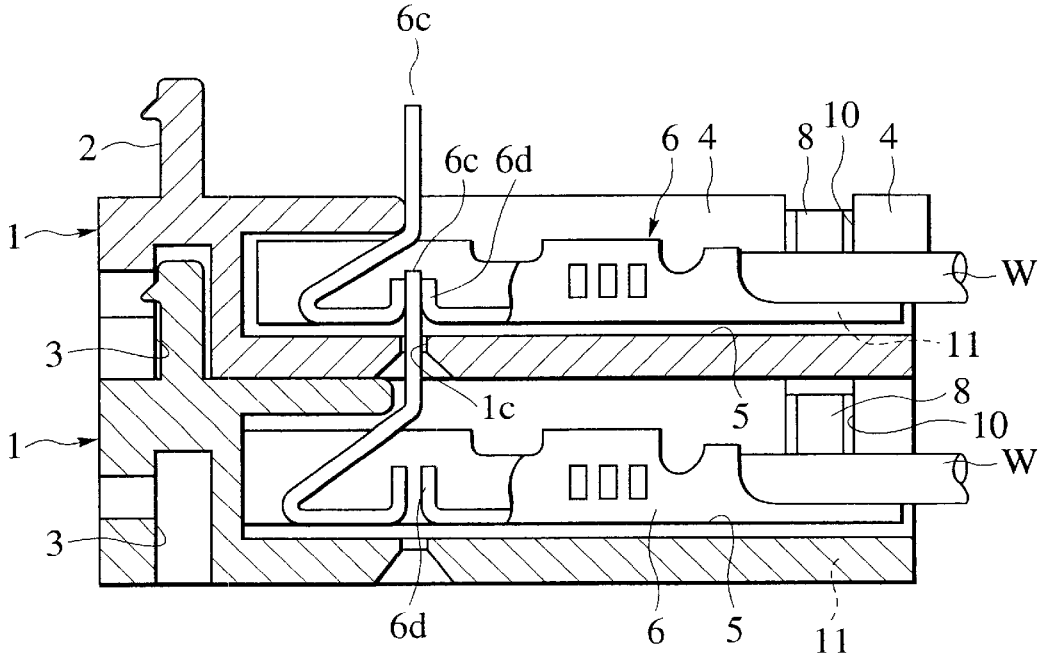
FIG. 10 is a cross section showing a connected state of the connector housings.

In addition, in accordance with the movement of both the connector housings 1 to the connecting position, the tab portions 6*c* of the terminals 6 of the lower connector housing 1 enter the upper connector housing 1, and as shown in FIG. 10, the tab portions 6*c* of the terminals 6 of the lower connector housing 1 are brought into contact with the tab contact portions 6*d* of the terminals 6 of the upper connector housing 1 in the connecting position. Here, in the case where the upper and lower terminals 6 do not electrically contact with each other, the tab portions 6*c* are previously bent.

Namely, as for the press-contact joint connector, the upper and lower terminals 6 and the adjacent right and left terminals 6 can be electrically connected as the need arises.

Figure 11A:
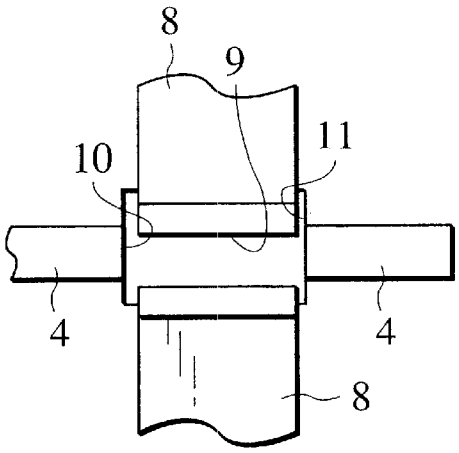
FIG. 11A is a plan view of a cut place of the carrier portion.
Figure 11B:
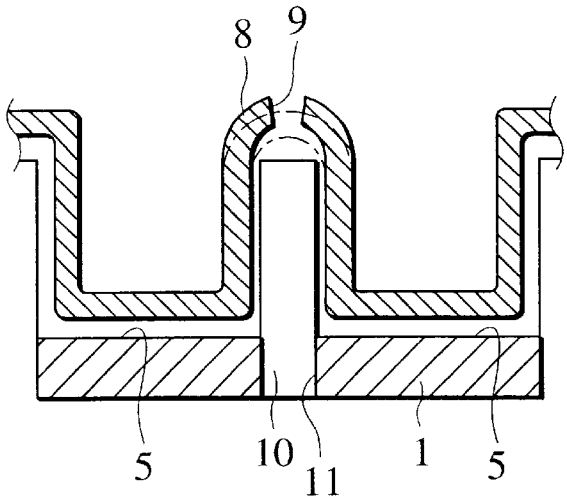
FIG. 11B is a cross section of FIG. 11A.

However, in the above press-contact joint connector, since carrier portions 8 of the terminal assembly 7 are formed into the continuous wave form as mentioned above, the carrier portions 8 are arranged on the cavity walls 4 as follows. Namely, the uncut sections of the carrier portions 8 are arranged so as to stretch over the cavity walls 4, and as shown in FIGS. 11A and 11B, the sections where the cut spaces 9 are formed are arranged so that the cut end surfaces of the carrier portions 8 face each other across the notched portions 10. Therefore, when vibration or external force is applied to the carrier portions 8, the cut end surfaces of the carrier portions 8 are brought into contact with each other as represented by a hypothetical line in FIG. 11B, and thus the adjacent terminals 6 are possibly short-circuited.

Figure 12A:
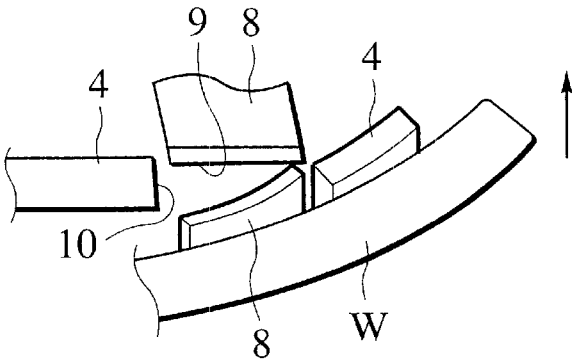
FIG. 12A is a plan view showing a state that an external force is applied from an electric wire in the example.
Figure 12B:
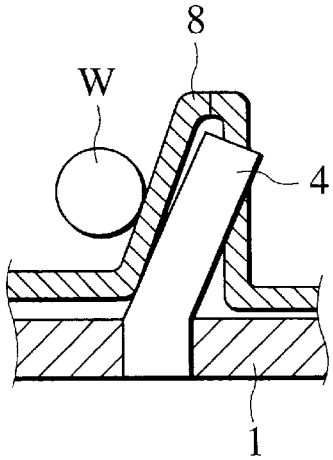
FIG. 12B is a cross section of FIG. 12A.
Figure 13A:
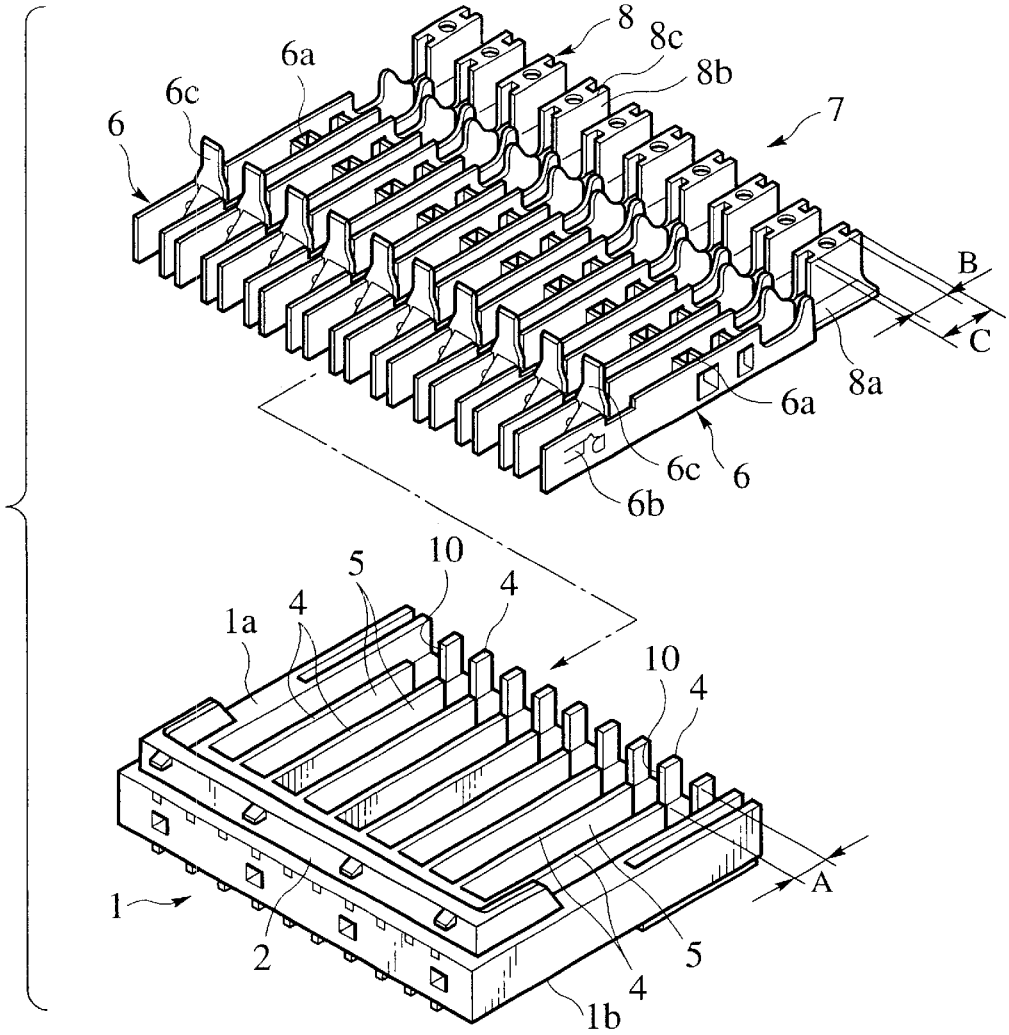
FIG. 13A is a perspective view of a connector housing and a terminal assembly of a press-contact joint connector according to a second embodiment of the present invention.
Figure 13B:
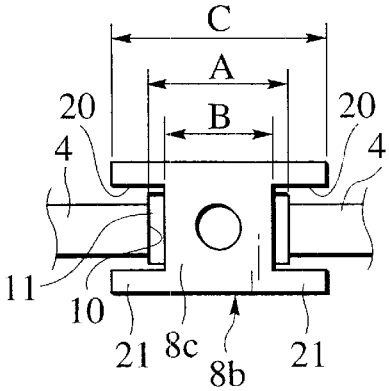
FIG. 13B is a plan view showing a state before upper portions of carrier portions are cut.
Figure 13C:
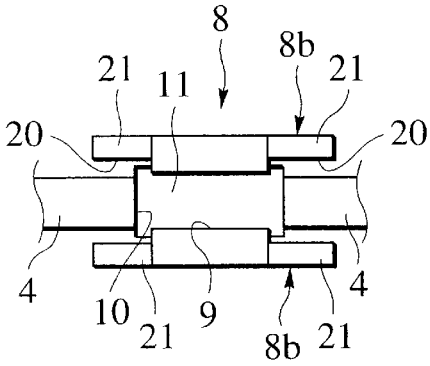
FIG. 13C is a plan view showing a state after the upper portions of the carrier portions are cut.
Figure 14:
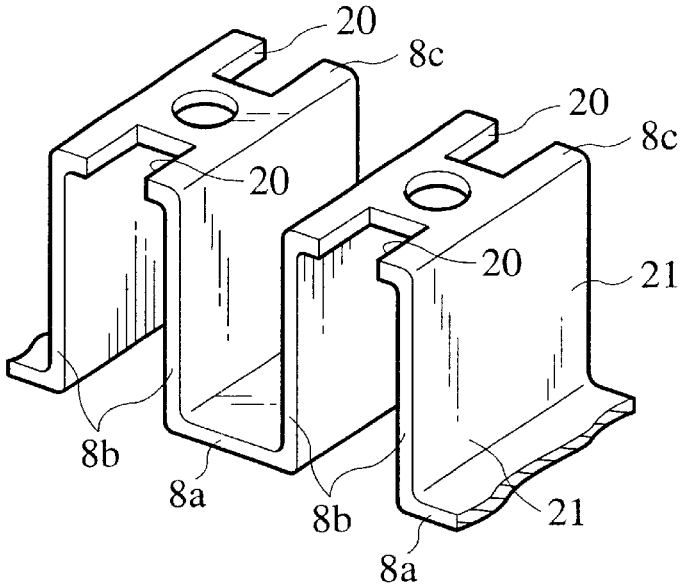
FIG. 14 is a partial perspective view of the carrier portions of the present invention.

In addition, when the electric wires W are bent, as shown in FIGS. 12A and 12B, the cavity walls 4 and the carrier portions 8 are bent by the external force. As a result, the cut end surfaces of the carrier portions 8 come in contact with each other as shown in FIGS. 12A and 12B, and the adjacent terminals 6 are short-circuited.

In this connection, the applicants have improved the press-contact joint connector as described in a second and fourth embodiments hereinbelow.

FIGS. 13A through 15B show a second embodiment of the present invention. In the second embodiment, as for the parts of the structure which are the same as the first embodiment, the description thereof is omitted in order to avoid duplex description, and only different parts will be described. Moreover, in the case where the parts of the structure which are identical to the first embodiment are shown in the drawings, the same reference numerals are given to them.

Namely, in the second embodiment, similarly to the first embodiment, carrier portions 8 have the continuous wave form. More concretely, the carrier portion 8 has a lower surface portion 8*a* which is connected to a terminal 6 and is provided along a lower surface of a terminal housing chamber 5, right and left stand portions 8*b* which stand up from both ends of the lower surface portion 8*a*, and upper surface portion 8*c* which connects upper parts of the adjacent stand portions 8*b* positioned in the terminal housing chambers 5. In the second embodiment, notched portions 20 are formed on both sides of the upper surface portion 8*c*, and due to the notched portions 20 on both the sides, a width B of the upper surface portion 8*c* is set so as to be smaller than a width C of the stand portion 8*b*. Moreover, a width A of the notched portion 10 of the cavity wall 4 is set to a dimension between the width B of the upper surface portion 8*c* of the carrier portion 8 and the width C of the stand portion 8*b* of the carrier portion 8, and as a result both the sides of the stand portion 8*b* of the carrier portion 8 are constituted as overlap portions 21 which overlap the cavity wall 4. The other parts of the structure are the same as those in the first embodiment.

Next, there will be described below the attachment of the terminals to the connector housing 1 and the connection of the connector housings 1. The attachment of the terminals to the connector housing 1 is the same as that in the first embodiment, and the connection between the adjacent terminals 6 which do not require electrical connection is cut by using a carrier cut jig device 12. Since the width B of the carrier portion 8 is smaller than the width A of the notched portion 10 of the cavity wall 4, the carrier portion 8 positioned between the terminals 6 which do not require electrical connection can be cut in the state that the terminal assembly 7 is attached to the connector housing 1.

In addition, the connection between the connector housings 1 is the same as that in the first embodiment. In the press-contact connector housings which are connected in such a manner, the sections of the cut spaces 9 are positioned so that the cut end surfaces of the carrier portions 8 face each other across the notched portions 10. However, even if an external force is applied in a direction where the adjacent stand portions 8*b* come close to each other, the overlap portions 21 of the stand portions 8*b* are brought into contact with the cavity walls 4 so that displacement is prevented. As a result, the cut end surfaces of the carrier portions 8 do not contact with each other. Therefore, the insulation between the adjacent terminals 6 can be ensured.

Figure 15A:
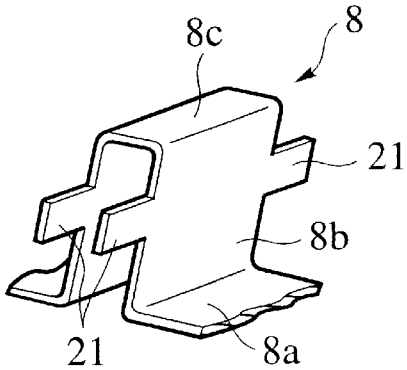
FIG. 15A is a partial perspective view of the carrier portion of the present invention which is partially modified.
Figure 15B:
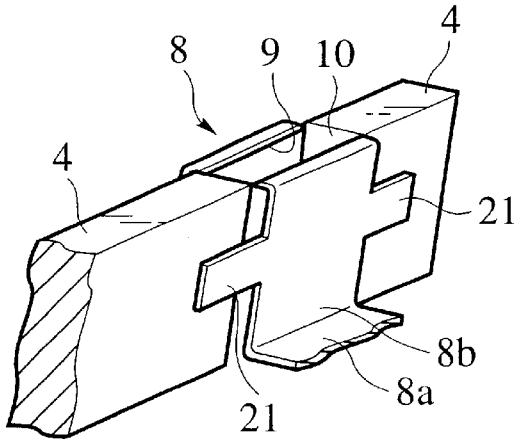
FIG. 15B is a partially perspective view showing the state that the upper portion of the carrier portion is cut.

FIGS. 15A and 15B show a modified example of the second embodiment of the present invention, and FIG. 15A is a partially perspective view of the carrier portion, and FIG. 15B is a partially perspective view showing the state that the upper surface portion of the carrier portion is cut. A difference between the modified example of the second embodiment and the first embodiment is that the overlap portions 21 are protruded integrally from both the sides of the stand portion 8*b* of the carrier portion 8. The other parts of the structure are the same as those in the first embodiment.

In the above structure, the sections of the cut spaces 9 are arranged so that the cut end surfaces of the carrier portions 8 face each other across the notched portion 10, and even if the external force is applied in the direction where the adjacent stand portions 8*b* come close to each other, the overlap portions 21 of the stand portions 8*b* abut against the cavity walls 4 so that displacement is prevented. As a result, the cut end surfaces of the carrier portion 8 do not contact with each other. Therefore, similarly to the second embodiment, the insulation between the adjacent terminals 6 can be ensured.

Namely, in the second embodiment, the notched portions 20 are provided to the upper surface portion 8*c* of the carrier portion 8 so that the overlap portions 21 are constituted, and in the modified example of the second embodiment, some parts of the stand portions 8*b* are protruded so that the overlap portions 21 are constituted, but the overlap portions 21 may be constituted by combining both the structures.

Figure 16:
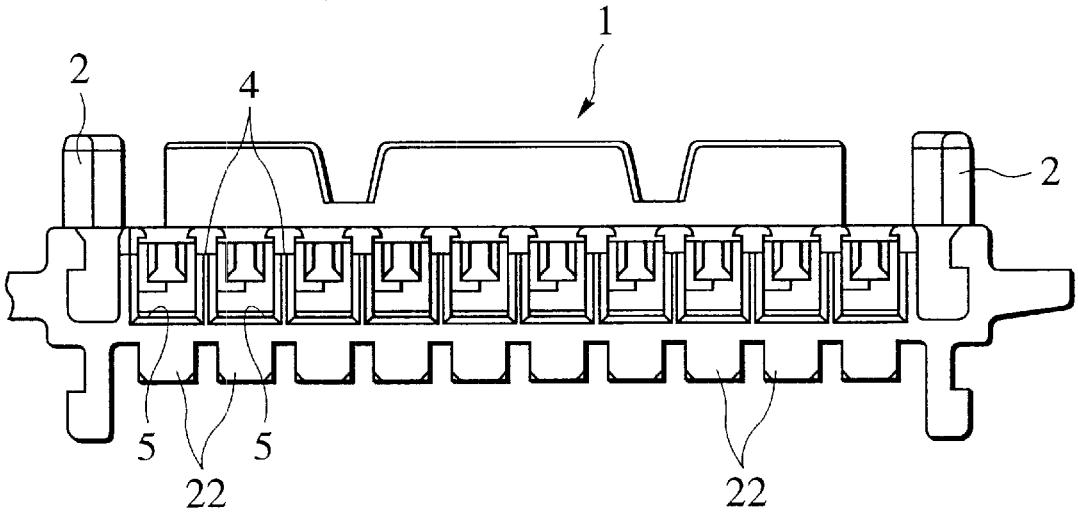
FIG. 16 is a rear view of a connector housing according to a third embodiment of the present invention.
Figure 17A:
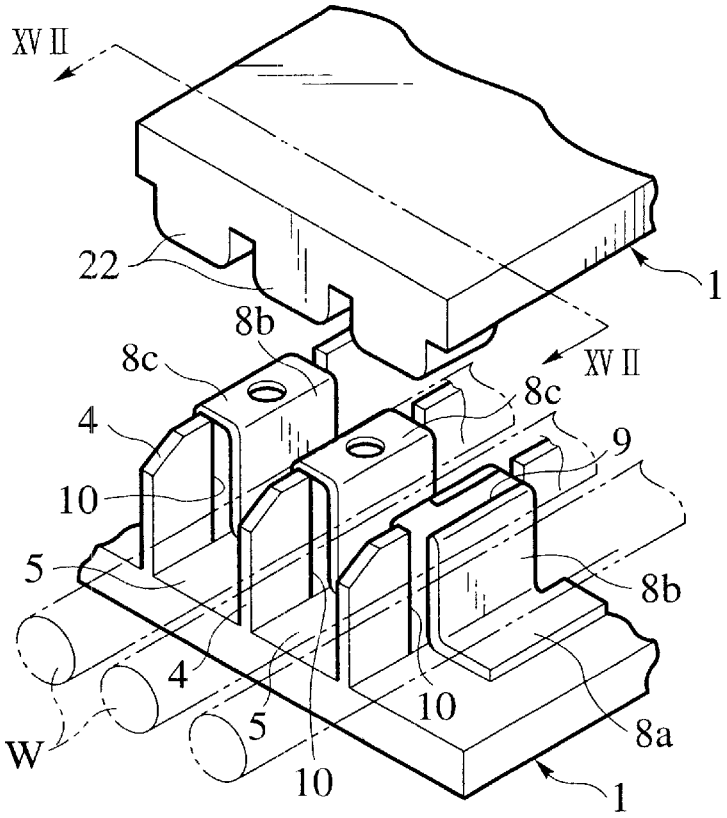
FIG. 17A shows a partially exploded view showing a rear side of the connected connector housings.
Figure 17B:
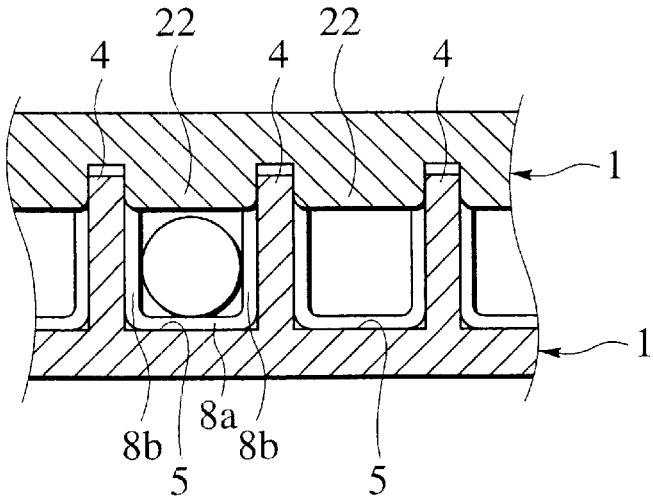
FIG. 17B is a cross section taken along the line XVII—XVII of FIG. 17A.

FIGS. 16 through 17B show a third embodiment of the present invention, and FIG. 16 is a rear view of the connector housing, and FIG. 17A is a partially exploded perspective view showing a rear side of the connected connector housings, and FIG. 17B is a cross section of FIG. 17A. In the third embodiment, as for the parts of the structure which are the same as those in the first embodiment, the description thereof is omitted in order to avoid duplex description, and only different parts will be described. Moreover, in the case where the parts same as those in the first embodiment are shown in the drawings, the same reference numerals are give to them.

Namely, in the third embodiment, cavity holding portions 22, which sandwich the cavity walls 4 of the lower connector housing 1 to the rear of the notched portions 10, are provided on the lower surface of the upper connector housing 1. The other parts of the structure are the same as those in the first embodiment.

According to the third embodiment, the sections of the cut spaces 9 are arranged so that the cut end surfaces of the carrier portions 8 face each other across the notched portions 10, but since even if the external force is applied to the cavity walls 4 due to the bending of the electric wires W, displacement of the cavity walls 4 is prevented by the cavity holding portions 22, the cut end surfaces of the carrier portions 8 do not contact with each other. Therefore, the insulation between the adjacent terminals 6 can be ensured. Moreover, the deformation of the cavity walls 4 can be prevented.

Figure 18A:
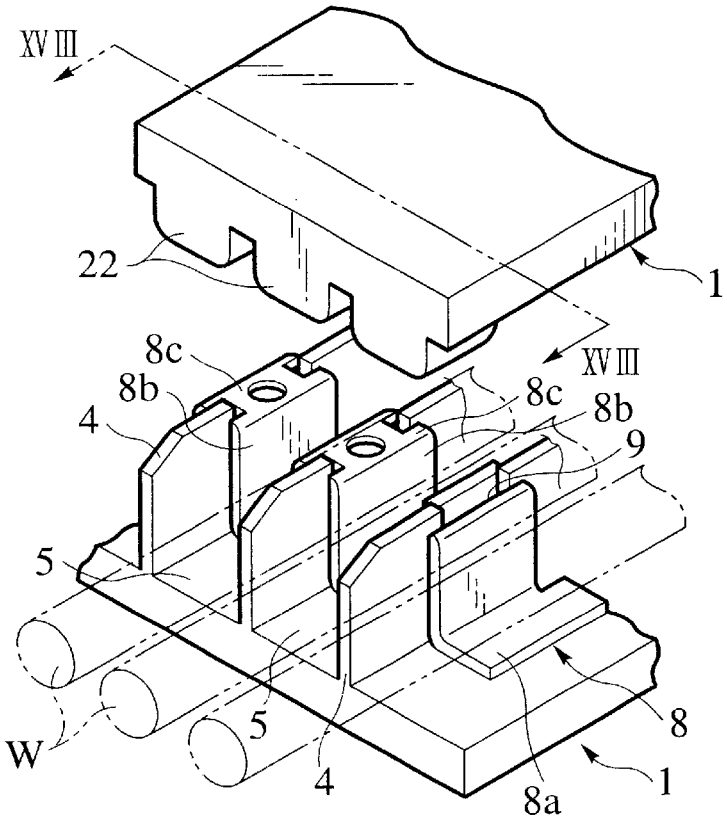
FIG. 18A is a partially exploded perspective view showing the rear side of the connector housings according to a fourth embodiment of the present invention.
Figure 18B:
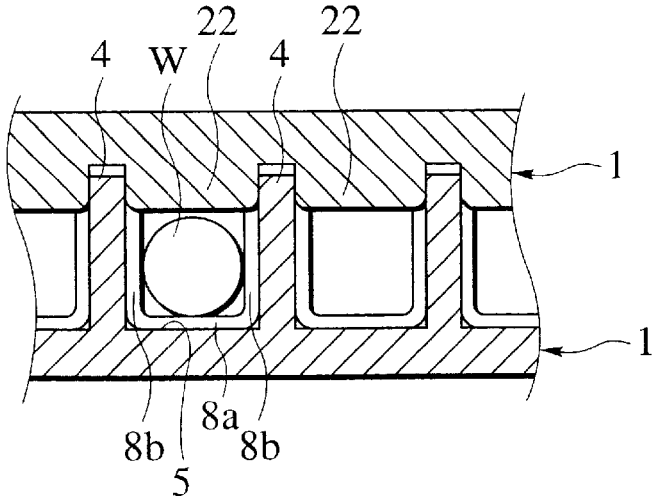
FIG. 18B is a cross section taken along the line XVIII—XVIII of FIG. 18A.

FIGS. 18A and 18B show a fourth embodiment of the present invention. The fourth embodiment is constituted so that the second embodiment and the third embodiment are combined. Namely, the overlap portions 21 are formed on the stand portions 8*b* of the carrier portions 8, and the cavity holding portions 22 are provided to the lower surface of the upper connector housing 1. The other parts of the structure are the same, and the description thereof is omitted in order to avoid duplex description. Moreover, in the case where the parts of the structure which are the same as those in the second embodiment are shown in the drawings, the same reference numerals are given to them.

In the fourth embodiment, even if an external force is applied in a direction where the adjacent stand portions 8*b* come close to each other, the overlap portions 21 of the stand portions 8*b* abut against the cavity walls 4 so that the displacement is prevented. Moreover, even if an external force is applied to the cavity walls 4 due to the bending of the electric wires W, the displacement of the cavity walls 4 is prevented by the cavity holding portions 22. As a result, the cut end surfaces of the carrier portions 8 do not contact with each other. Therefore, the insulation between the adjacent terminals 6 can be ensured. Moreover, deformation of the cavity walls 4 can be prevented.

FIGS. 19A through 22 show a fifth embodiment of the present invention.

In the fifth embodiment, as for the parts of the structure which are the same as those in the first embodiment, the description thereof is omitted in order to avoid duplex description, and only the different parts will be described.

Moreover, in the case where the parts of the structure which are the same as those in the first embodiment are shown in the drawings, the same reference numerals are given to them.

Figure 19A:
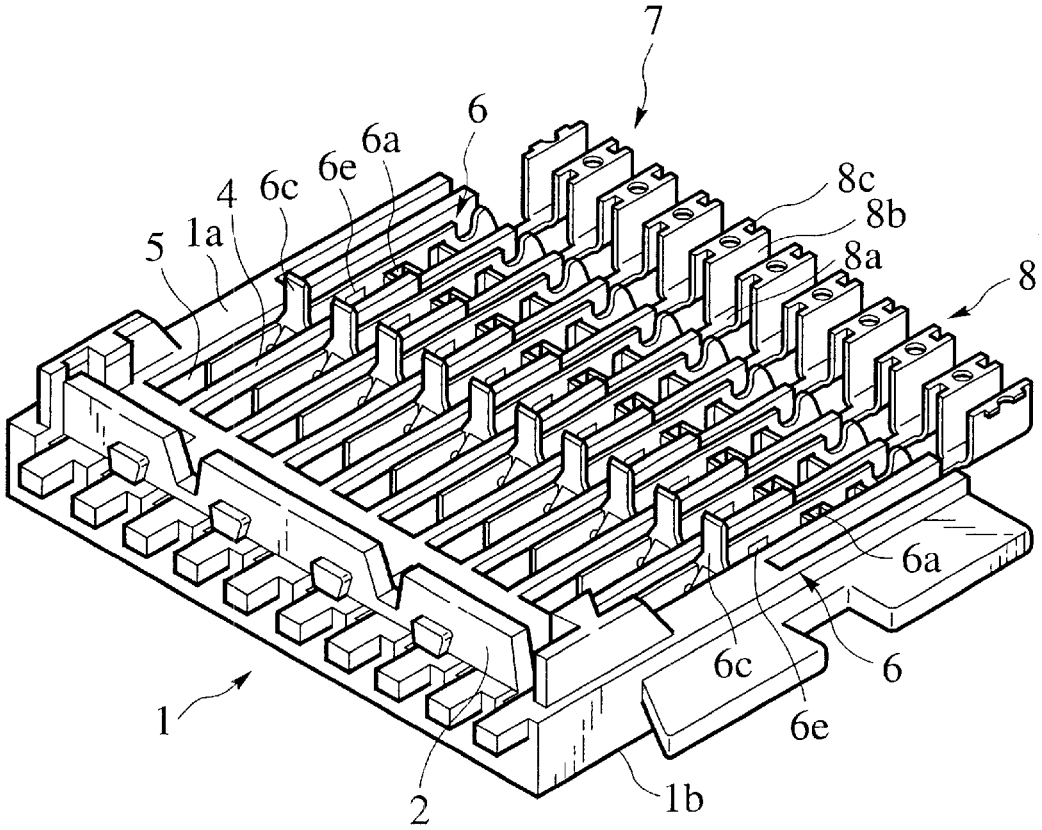
FIG. 19A is a perspective view of the connector housing according to a fifth embodiment of the present invention in a state that the terminal assembly is inserted to a temporary engagement position.
Figure 19B:
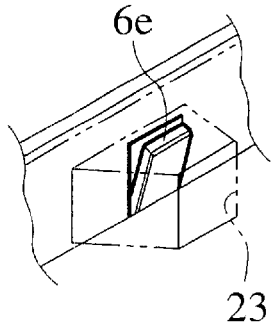
FIG. 19B is a perspective view showing a main portion in a state that the terminal assembly is temporarily engaged with the connector housing.

Namely, in the fifth embodiment, the carrier cutting hole 11 is not provided to the connector housing 1. Moreover, the notched portion 10 is not provided to the cavity wall 4, and all the adjacent terminal housing chambers 5 are partitioned by the cavity walls 4. Moreover, as shown in FIG. 19B, a temporary engagement groove portion 23 is provided to the cavity walls 4, and a housing temporary engagement protrusion 6e is provided to the terminals 6 of the terminal assembly 7. The housing temporary engagement protrusions 6e of the terminals 6 are inserted respectively into the temporary engagement grooves 23 of the cavity walls 4 in a temporary engagement position shown in FIG. 19A so that the terminal assembly 7 is temporarily engaged. Further, similarly to the third embodiment, the cavity holding portions 22 are provided to the lower surface of the connector housing 1.

Next, there will be described below the attachment of the terminals to the connector housing 1 and the connection between the connector housings 1. The terminal assembly 7 is inserted to the temporary engagement position shown in FIG. 19A from the rear surfaces of the plural terminal housing chambers 5 of the connector housing 1. When the terminals 6 are inserted to the temporary engagement position, as shown in FIG. 19B, the housing temporary engagement portions 6*e* of the terminals 6 are engaged with the terminal temporary engagement groove portions 23 of the connector housing 1. In this temporary engagement state, the carrier portions 8 of the terminal assembly 7 are protruded from the rear surface of the connector housing 1.

Next, the upper surface portion 8*c* of the carrier portion 8 between the adjacent terminals 6 not required electrical connection is cut by using the carrier cut jig device 12. When the carrier cutting is completed, the terminals 6 are inserted respectively to the attaching positions of the terminal housing chambers 5. Then, the housing engagement portions 6*b* of the terminals 6 are engaged respectively with terminal engagement portions 1*c* of the connector housing 1.

Figure 20:
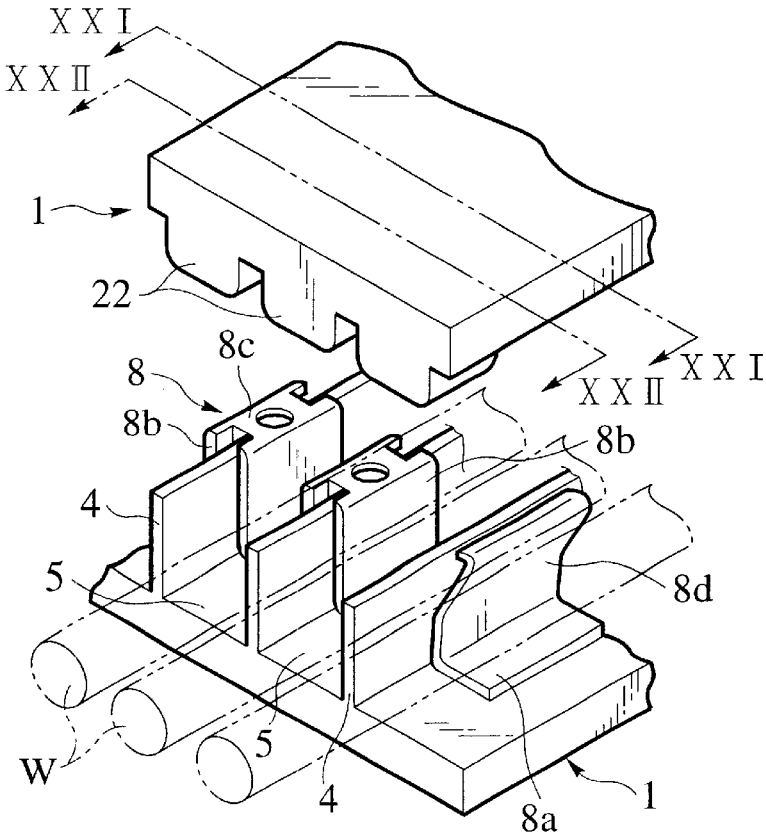
FIG. 20 is a partially exploded perspective view showing a rear side of the connected connector housings of the present invention.
Figure 21:
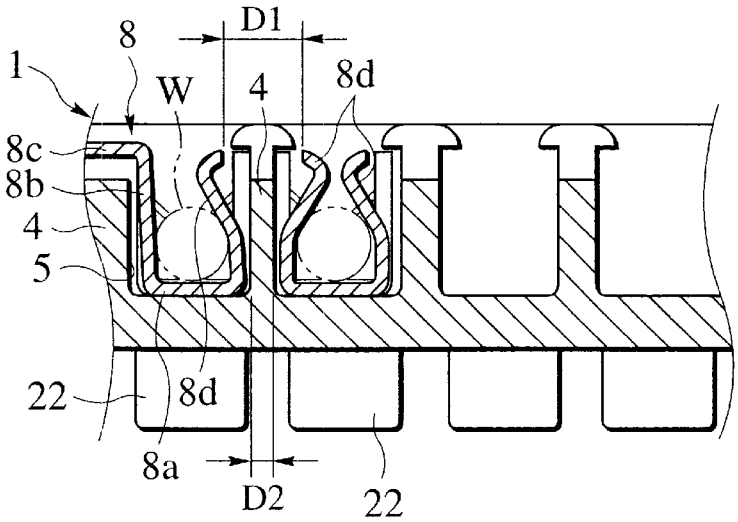
FIG. 21 is a cross section taken along the line XXI—XXI of FIG. 20.
Figure 22:
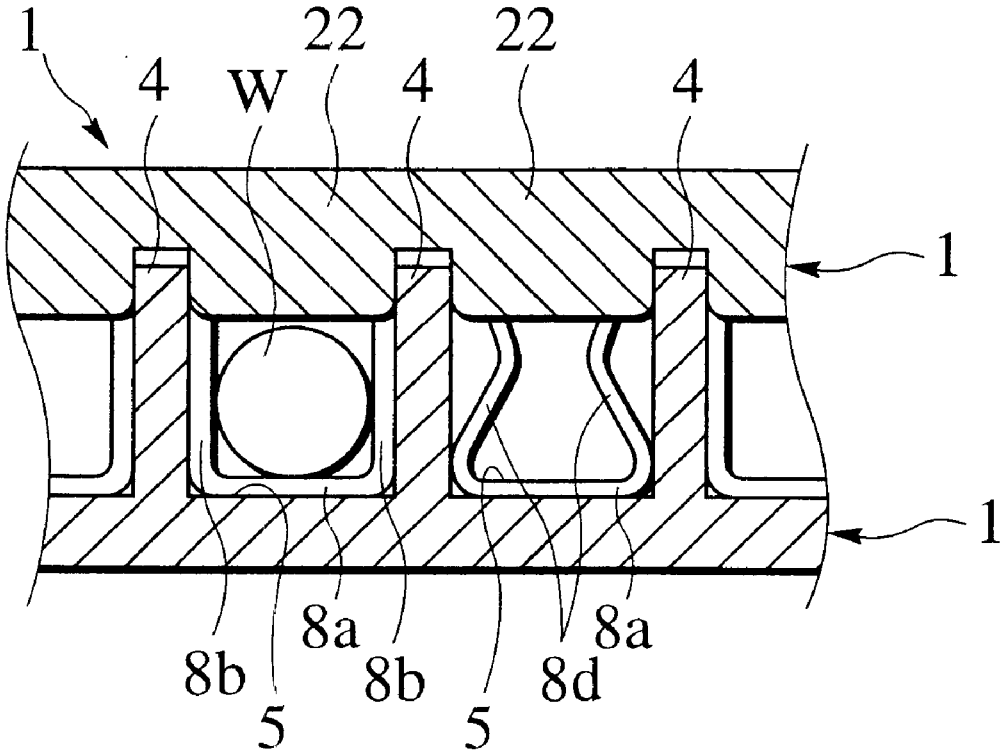
FIG. 22 is a cross section taken along the line XXII—XXII of FIG. 20.

Next, the electric wires W are brought into press-contact with the electric wire press-contact portions 6*a* of the terminals 6 so that the electric wires W are connected with the terminals 6. Thereafter, as shown in FIGS. 20 and 21, the two stand portions 8*b*, which are separated by cutting the upper surface portion 8*c* of the carrier portion 8, are bent respectively into the terminal hosing chambers 5 so that bent portions 8*d* are formed.

Next, the connection between the connector housings 1 is carried out, but this connecting work is the same as that in the first embodiment.

In the fifth embodiment, the cut end surfaces of the carrier portions 8 are arranged so as to face each other above the cavity walls 4, but since an interval D1 between the cut end surfaces at least becomes larger than a thickness D2 of the cavity wall 4, even if an external force is applied in the direction where the adjacent stand portions 8*b* come close to each other, the cut end surfaces of the carrier portions 8 do not contact with each other. Moreover, deformation of the cavity walls 4 due to the external force from the electric wires W can be suppressed by the cavity holding portions 22. As a result, the contact between the cut end surfaces of the carrier portions 8 due to the deformation of the cavity walls 4 can be prevented. Therefore, the insulation between the adjacent terminals 6 can be ensured more securely, and the deformation of the cavity walls 4 can be prevented.

In addition, in the fifth embodiment, all the adjacent terminal housing chambers 5 are partitioned by the cavity walls 4, and the cut end surfaces of the carrier portions 8 are arranged via the cavity walls 4. However, like the embodiment 1, even in the case where the notched portions are formed on the cavity walls 4 due to some reason and the cut end surfaces of the carrier portions 8 are arranged via the notched portions, the contact between the cut end surfaces of the carrier portions 8 due to the deformation of the cavity walls 4 can be prevented.

Figure 24:
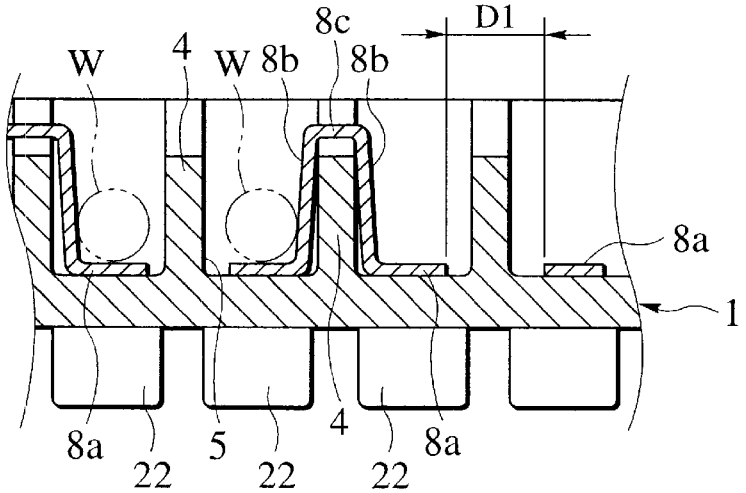
FIG. 24 is a cross section taken along the line XXIV—XXIV of FIG. 23.
Figure 25:
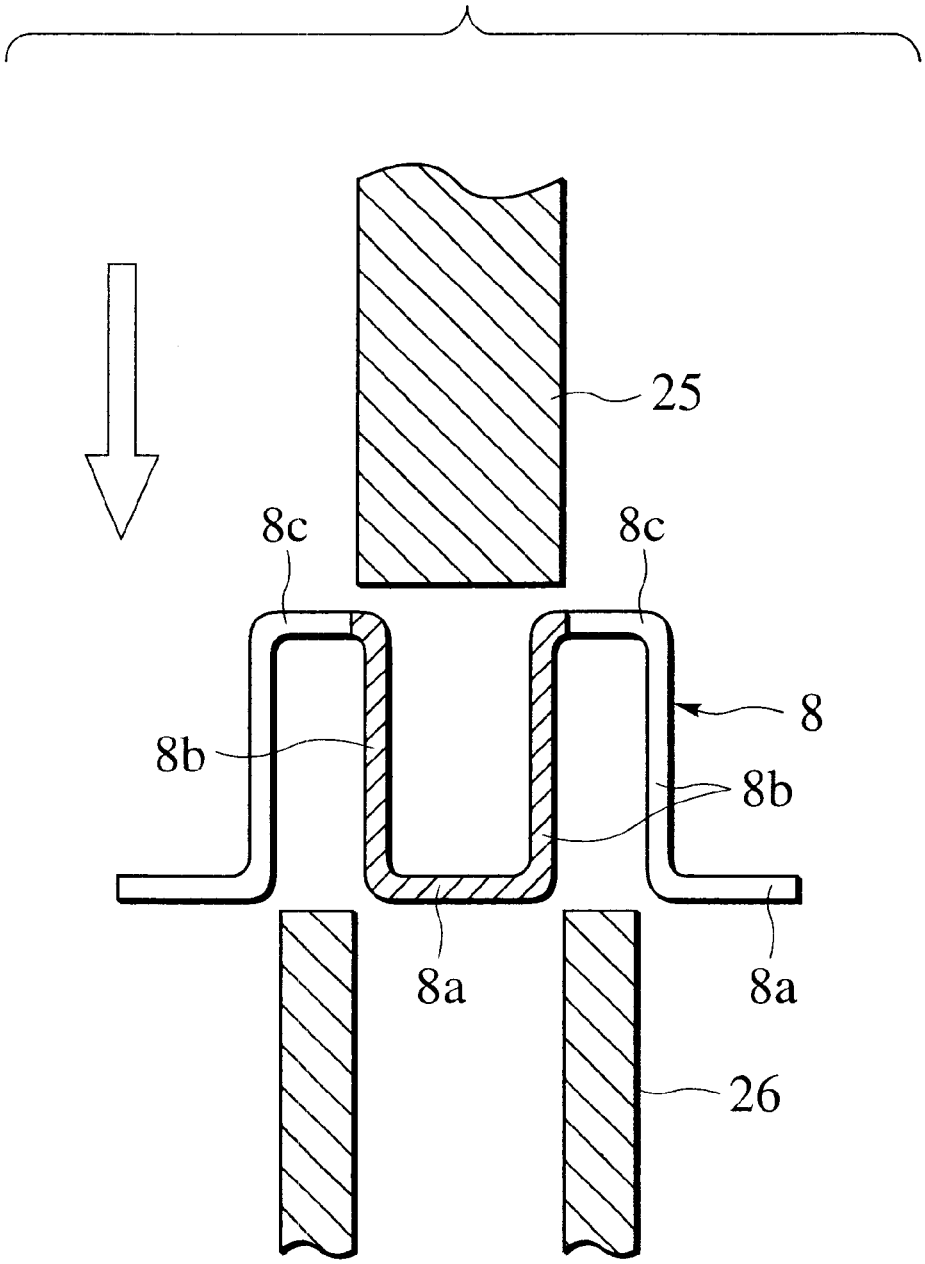
FIG. 25 is a cross section showing a cut state of the carrier portion of the present invention.

FIGS. 23 through 25 show a sixth embodiment. A great difference between the sixth embodiment of the fifth embodiment is a cutting range of the carrier portion 8, and the other parts are the substantially same as those in the fifth embodiment.

Namely, in the sixth embodiment, the upper surface portion 8*c* of the carrier portion 8, which is in the temporary engagement position of the terminal assembly 7 and is between the adjacent terminals 6 not requiring electrical connection, and the stand portions 8*b* on both the sides connected with the upper surface portion 8*c* are cut by using a punch 25 and die 26 as shown in FIG. 25.

In the sixth embodiment, since the cut end surfaces of the carrier portions 8 do not face each other above the cavity wall 4 and the interval D1 between the cut end surfaces is large, even if an external force is applied in the direction where the adjacent lower surface portions 8*a* come close to each other, the cut end surfaces of the carrier portions 8 do not contact with each other. Moreover, the deformation of the cavity walls 4 due to the external force from the electric wires W can be suppressed by the cavity holding portions 22. As a result, the contact between the cut end surfaces of the carrier portions 8 due to the deformation of the cavity walls 4 can be prevented. Therefore, the insulation between the adjacent terminals 6 can be ensured, and the deformation of the cavity walls 4 can be prevented. The sixth embodiment is provided mainly in order to prevent the deformation of the cavity walls 4.

In addition, in the sixth embodiment, after the terminals 6 are inserted to the attachment position, it is not necessary to bend the stand portions 8*b* unlike the embodiment 4.

In addition, in the sixth embodiment, all the adjacent terminal housing chambers 5 are partitioned by the cavity walls 4, and the cut end surfaces of the carrier portions 8 are arranged via the cavity walls 4. However, even in the case where the notched portions are formed on the cavity walls 4 due to some reason like the second embodiment and the cut end surfaces are arranged via the notched portions, the contact between the cut end surfaces of the carrier portions 8 due to the deformation of the cavity walls 4 can be prevented.

The entire contents of Japanese Patent Application P11-99332 (filed Apr. 6, 1999) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A press-contact joint connector, comprising:

a first connector housing having a plurality of cavity walls, said first connector housing being formed with a plurality of terminal housing chambers by partitioning said first connector housing by said plurality of cavity walls;

a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein notched portions are formed respectively in positions of said cavity walls corresponding to said carrier portions;

carrier cutting holes are formed below said notched portions of said first connector housing;

said carrier portions are composed of lower surface portions provided along bottom surfaces of said terminal housing chambers, stand portions which stand from said lower surface portions, and upper surface portions for connecting said adjacent stand portions; and overlap portions which are arranged so as to overlap said cavity walls are formed in positions correspondingly to said stand portions of said carrier portions.

2. A press-contact joint connector, comprising:

a first connector housing having a plurality of cavity walls, said first connector housing being formed with a plurality of terminal housing chambers by partitioning said first connector housing by said plurality of cavity walls;

a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein notched portions are formed respectively in positions of said cavity walls corresponding to said carrier portions;

carrier cutting holes are formed below said notched portions of said first connector housing;

said carrier portions are composed of lower surface portions provided along bottom surfaces of said terminal housing chambers, stand portions which stand from said lower surface portions, and upper surface portions for connecting said adjacent stand portions; and overlap portions which are arranged so as to overlap said cavity walls are formed in positions correspondingly to said stand portions of said carrier portions, wherein cavity holding portions which sandwich rear portions of said cavity walls are provided to a lower surface of said second connector housing.

3. A press-contact joint connector, comprising:

a first connector housing having a plurality of cavity walls, said first connector housing being formed with a plurality of terminal housing chambers by partitioning said first connector housing by said plurality of cavity walls;

a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein notched portions are formed respectively in positions of said cavity walls corresponding to said carrier portions;

carrier cutting holes are formed below said notched portions of said first connector housing;

said carrier portions are composed of lower surface portions provided along bottom surfaces of said terminal housing chambers, stand portions which stand from said lower surface portions, and upper surface portions for connecting said adjacent stand portions; and wherein cavity holding portions which sandwich said cavity walls to rear of said notched portions are provided to a lower surface of said second connector housing.

4. A press-contact joint connector, comprising:

a first connector housing having a plurality of cavity walls, said first connector housing being formed with a plurality of terminal housing chambers by partitioning said first connector housing by said plurality of cavity walls;

a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein said carrier portions are composed of lower surface portions provided along bottom surfaces of said terminal housing chambers, stand portions which stand from said lower surface portions, and upper surface portions for connecting said adjacent stand portions;

said upper surface portion is cut; and said two stand portions which are separated by cutting said upper surface portion are bent respectively into said terminal housing chambers.

5. A press-contact joint connector according to claim 4, wherein cavity holding portions which sandwich rear portions of said cavity walls are provided to a lower surface of said second connector housing.

6. A press-contact joint connector, comprising:

a first connector housing having a plurality of cavity walls, said first connector housing being formed with a plurality of terminal housing chambers by partitioning said first connector housing by said plurality of cavity walls;

a second connector housing being connected to an upper surface of said first connector housing in a multi-stage form; and a terminal assembly having a plurality of terminals to be housed respectively in said plurality of terminal housing chambers, said terminal assembly having a plurality of carrier portions for connecting said plurality of terminals, one of said plurality of carrier portions being cut as the need arises, wherein said carrier portions are composed of lower surface portions provided along bottom surfaces of said terminal housing chambers, stand portions which stand from said lower surface portions, and upper surface portions for connecting said adjacent stand portions; and said upper surface and said stand portions on both the sides connected to said upper surface are cut.

7. A press-contact joint connector according to claim 6, wherein cavity holding portions which sandwich rear portions of said cavity walls are provided to a lower surface of said second connector housing.

* * * * *